US007354271B2

(12) United States Patent
Brunn

(10) Patent No.: US 7,354,271 B2
(45) Date of Patent: Apr. 8, 2008

(54) TRAINING GRENADE

(76) Inventor: Michael Brunn, 308 Littleworth La., Sea Cliff, NY (US) 11579

( * ) Notice: Subject to any disclaimer, the term of this patent is extended or adjusted under 35 U.S.C. 154(b) by 561 days.

(21) Appl. No.: 10/841,270

(22) Filed: May 7, 2004

(65) Prior Publication Data

US 2005/0084827 A1 Apr. 21, 2005

Related U.S. Application Data

(60) Provisional application No. 60/469,304, filed on May 8, 2003.

(51) Int. Cl.
*F41A 33/00* (2006.01)

(52) U.S. Cl. ..... 434/12

(58) Field of Classification Search ..... 102/368, 102/482, 486, 487; 434/12
See application file for complete search history.

(56) References Cited

U.S. PATENT DOCUMENTS 4,392,432 A 7/1983 Fenrick et al.
4,932,328 A * 6/1990 Pinkney et al. ..... 102/482
4,932,329 A 6/1990 Logie
4,947,753 A 8/1990 Nixon, III
5,246,372 A 9/1993 Campagnuolo et al.
5,351,623 A 10/1994 Kissel et al.
6,065,404 A 5/2000 Ripingill, Jr. et al.
6,450,817 B1 9/2002 Deinlein
6,579,097 B1 6/2003 Sampson et al.
6,599,127 B1 7/2003 Hopmeier et al.

OTHER PUBLICATIONS

Hand Grenades: Gary's U.S. Infantry Weapons Reference Guide.*
Field Manual No. 3-23.30, Washington, DC, Sep. 1, 2000, Department of the Army.*
Combined Tactical Systems, INC. Product Specification Sheet.*

* cited by examiner

*Primary Examiner*—John M. Hotaling, II
*Assistant Examiner*—Jeffrey K Wong
(74) *Attorney, Agent, or Firm*—Cohen Pontani Lieberman & Pavane LLP

(57) ABSTRACT

A training grenade having reversed threading connecting the fuze assembly and the housing. A tubular interior of the fuze assembly contains a two part fuze charge being five times the size of the fuze charge in a live grenade. The two part fuze charge consists of a delay charge and an output charge, where the delay charge burns down first and ignites the output charge, whose explosion simulates the explosion of a live grenade.

21 Claims, 2 Drawing Sheets

Live Grenade

Trainer Grenade
Fuze Assembly
Top View

Trainer Grenade
Fuze Assembly

Trainer Grenade
Fuze Assembly without Lever

Trainer Grenade

TRAINING GRENADE

RELATED APPLICATIONS

This application claims priority from U.S. Provisional Patent Application Ser. No. 60/469,304 which was filed on May 8, 2003, and which is hereby incorporated in its entirety.

BACKGROUND OF THE INVENTION

1. Field of the Invention

The present invention relates generally to devices for training personnel in the use of munitions, and particularly to a training device for simulating the actions of a less-lethal grenade.

2. Description of the Related Art

Training for the use of lethal and less-lethal munitions, such as grenades, requires as realistic a simulation as possible in order to adequately prepare the trainee for the real experience. However, it is difficult for military and/or police forces to realistically simulate the experience of a live grenade during training operations because the munitions used for training need to sound and act as much like live munitions as possible without needlessly endangering the trainees. On the one hand, the more realistic the simulated grenade is, the more dangerous the simulation is. On the other hand, the safer the simulation is, the more unrealistic the simulated grenade is.

U.S. Pat. No. 5,246,372 to Campagnuolo et al. describes a training grenade which uses a high intensity flashbulb and electronic circuitry to mimic the action of a live grenade. The grenade housing is translucent or transparent so that the flash of the flashbulb may be seen. A sonic buzzer goes off when the training grenade is activated in order to inform the trainee. The flash of the flash bulb is appropriately timed by the electronic circuitry to mimic the timing of a live grenade. Although this type of training grenade is safe, it does not provide a realistic simulation of a live grenade.

U.S. Pat. No. 5,351,623 to Kissel et al. describes a training grenade which uses a specialty "shock" tube that produces a loud noise and a bright flash of light when ignited by electronic circuitry located in the grenade housing. The ignition is also appropriately timed by the electronic circuitry. Although this grenade provides a more realistic simulation, it is more dangerous, as a shock wave is shot out of the end of the shock tube. Furthermore, this training grenade requires electronic circuitry which can be damaged or destroyed by repeated usage, and will increase the cost of the training grenade.

U.S. Pat. No. 4,932,329 to Logie describes a training grenade with a housing of foam polystyrene which contains dye powder and a small charge. When the small charge is ignited, the housing is blown apart thereby dispersing the dye powder. This leaves the dye powder behind, and completely destroys the training grenade in the process. Although it provides an interesting simulation of a live grenade, this training grenade is not reusable.

All of the patents discussed above are incorporated by reference in their entirety.

This brief review of prior art training grenades reveals some of the problems with prior art training grenades. Some are not reusable; some are reusable but require electronic circuitry which costs more money, results in a more complicated mechanism, and may not be robust enough to survive the wear and tear of repeated training exercises. Some are safe, but not very realistic; others are realistic, but use explosives which makes them less safe or at least potentially damaging to their own electronic circuitry.

Thus, there is a need for a training grenade which is reusable, realistic, robust, and safe.

SUMMARY OF THE INVENTION

One object of the present invention is to provide a training device for simulating a munition.

Another object of the present invention is to provide a training device with a relatively simple mechanism which is capable of repeated use.

Yet another object of the present invention is to provide a training device which closely simulates the effects of a live munition without endangering trainees.

Still another object of the present invention is to provide a training device with additional safety precautions in order to insure that training components are not accidentally mistaken for components used in live munitions.

These and other objects are accomplished by a training grenade having a housing with substantially the same weight and dimensions as the housing of the live grenade being simulated and fuze assembly with substantially the same dimensions as the fuze assembly of the live grenade being simulated.

According to one aspect of the present invention, the housing has a threaded opening on top, where the threading of the threaded opening is the reverse of the threading of the threaded opening in the live grenade being simulated. Similarly the fuze assembly has a threaded portion which screws into the threaded opening of the housing, wherein the threading of the threaded portion is the reverse of the threading of the threaded portion of the fuze assembly of the live grenade being simulated. By these means, it is not possible to attach a trainer fuze assembly to a live grenade, and vice-versa.

According to another aspect of the present invention, the fuze assembly has a tubular interior containing a fuze charge with two parts: a delay charge, which is ignited by a striker and is located at an upper portion of said tubular interior, and an output charge, which is located in a lower portion of said tubular interior and is ignited by the delay charge. The output charge simulates the detonation of the main charge in the live grenade being simulated and the two part fuze charge is a multiple in size of the fuze charge in the grenade being simulated.

According to yet another aspect of the present invention, the housing has a plurality of vents surrounding the periphery of the threaded opening and, when the output charge detonates, the shock waves and explosive gasses resulting therefrom discharges out through the plural vents of the housing. Thus, the housing and the fuze assembly of the trainer grenade can be reused.

According to still another aspect of the present invention, the components of the trainer grenade are color-coded in order to distinguish them from the components of a live grenade.

Other objects and features of the present invention will become apparent from the following detailed description considered in conjunction with the accompanying drawings; whereas the various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

The problem of providing a realistic simulation without needlessly endangering the trainees is particularly acute when training for the use of less-lethal grenades, because less-lethal munitions are often used for immobilizing or incapacitating an opponent who may pose a lethal threat if not effectively incapacitated or immobilized. Thus, less-lethal grenades require a subtlety and finesse not necessarily required by lethal munitions.

The presently preferred embodiment of the present invention is a training model of a spherical less-lethal rubber grenade, the 95 Series Sting-Ball™ rubber grenade from Combined Tactical Systems, Inc., 388 Kinsman Rd., Jamestown, Pa. However, although the presently preferred embodiment described herein is a training device which simulates a less-lethal grenade, the present invention may be applied to lethal as well as less-lethal munitions, as would be known to one skilled in the art.

Figure 1:
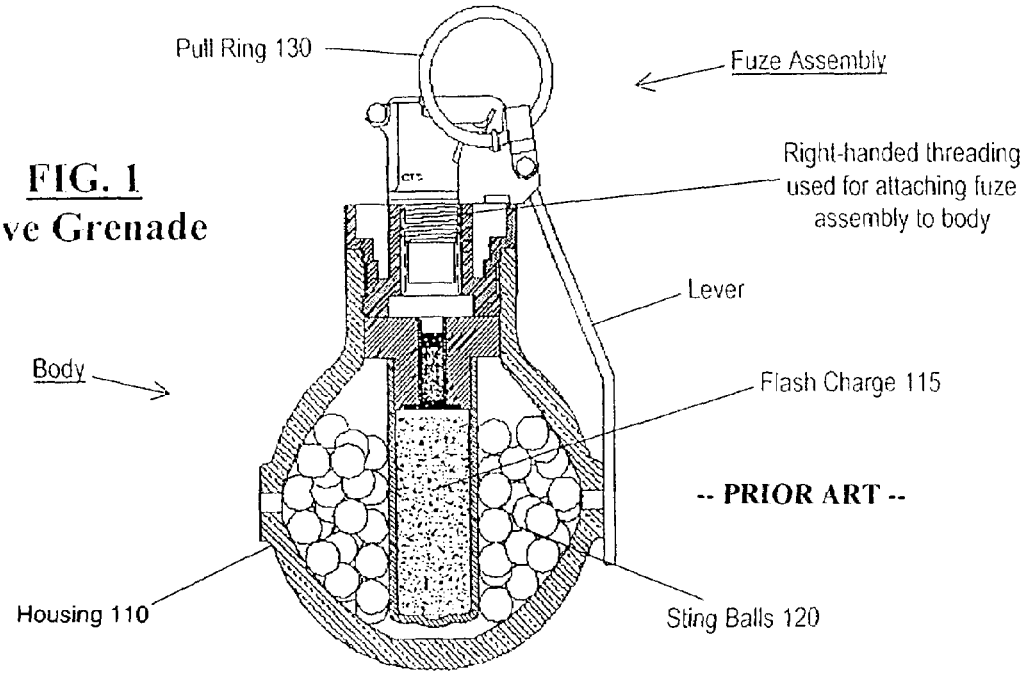
FIG. 1 is a schematic drawing of a live less-lethal Sting-Ball™ grenade.

The Sting-Ball™ can be launched by shotgun or thrown by hand and is capable of various less-lethal payloads, such as sting-balls and/or irritant powder additives (e.g., CN, CS, and OC). As shown in FIG. 1, the housing 110 of the Sting-Ball™ is made of rubber while the payload consists of a central flash charge 115 and rubber sting mini balls 120 which disperse in a circular pattern upon detonation of the flash charge. Because the fuze assembly is made of plastic, which could be lethal if dispersed by the central flash charge, the Sting-Ball™ has an ejection charge for separating the fuze assembly from the housing 110 before the flash charge 115 is detonated. Thus, after the hinge pin is released by pulling on pull ring 130, there is about a 1.5 second delay before the ejection charge separates the fuze assembly from housing 110, and then there is another roughly 1.5 second delay before the flash charge 115 is detonated, dispersing the sting balls 120.

Figure 4:
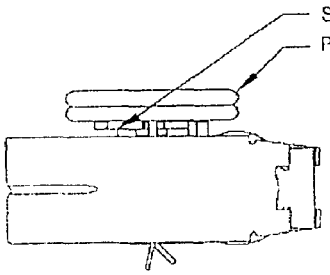
FIG. 4 is a schematic drawing of a plan view of the fuze assembly according to a preferred embodiment of the present invention.
Figure 2:
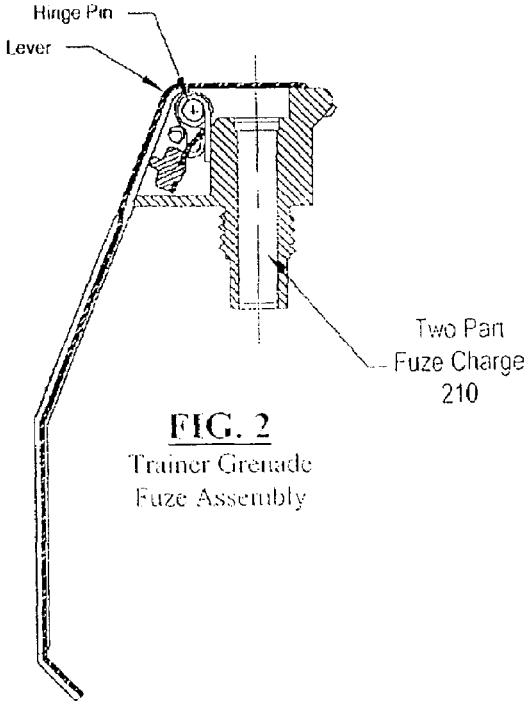
FIG. 2 is a schematic drawing of the fuze assembly of a trainer grenade according to a preferred embodiment of the present invention.
Figure 3:
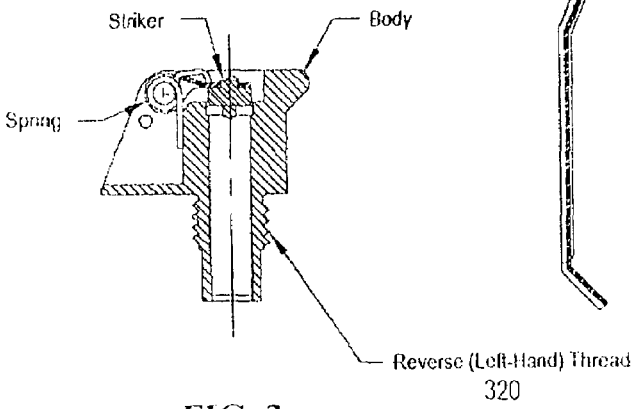
FIG. 3 is a schematic drawing of the fuze assembly according to a preferred embodiment of the present invention, but without the lever.

In order to simulate the live Sting-Ball™ as closely as possible, the trainer grenade according to a preferred embodiment of the present invention has the same dimensions and weight as the live Sting-Ball™. There is no flash charge in a trainer grenade; however, the fuze charge in the trainer grenade according to the preferred embodiment of the present invention is increased (e.g., to five times the fuze charge in the live munition) in order to simulate the loud report of the live grenade. The components comprising the fuze assembly of a trainer grenade according to the preferred embodiment is shown in FIGS. 2-3-4. FIG. 2 shows the entire fuze assembly. FIG. 3 shows the fuze assembly without the lever, so that the striker has struck at the top of the fuze charge. FIG. 4 is a plan view of the fuze assembly In order to simulate the two-part delay of the live Sting-Ball™ (i.e., ~1.5 seconds before the ejection charge, and then ~1.5 seconds before the flash charge), the trainer grenade according to the preferred embodiment of the present invention has a two-part fuze charge 210: a longer delay (i.e., ~3 seconds) charge, and the much larger output charge which detonates at the end of the delay.

In order to differentiate training grenades from live grenades, the threading 320 for the screw means of attaching the fuze assembly to the body of the trainer grenade is reversed, i.e., the threading is left-handed rather than right-handed. Thus, it is impossible to insert the trainer fuze assembly into a live grenade body, and it is impossible to insert a live fuze assembly into a trainer grenade body.

Figure 5:
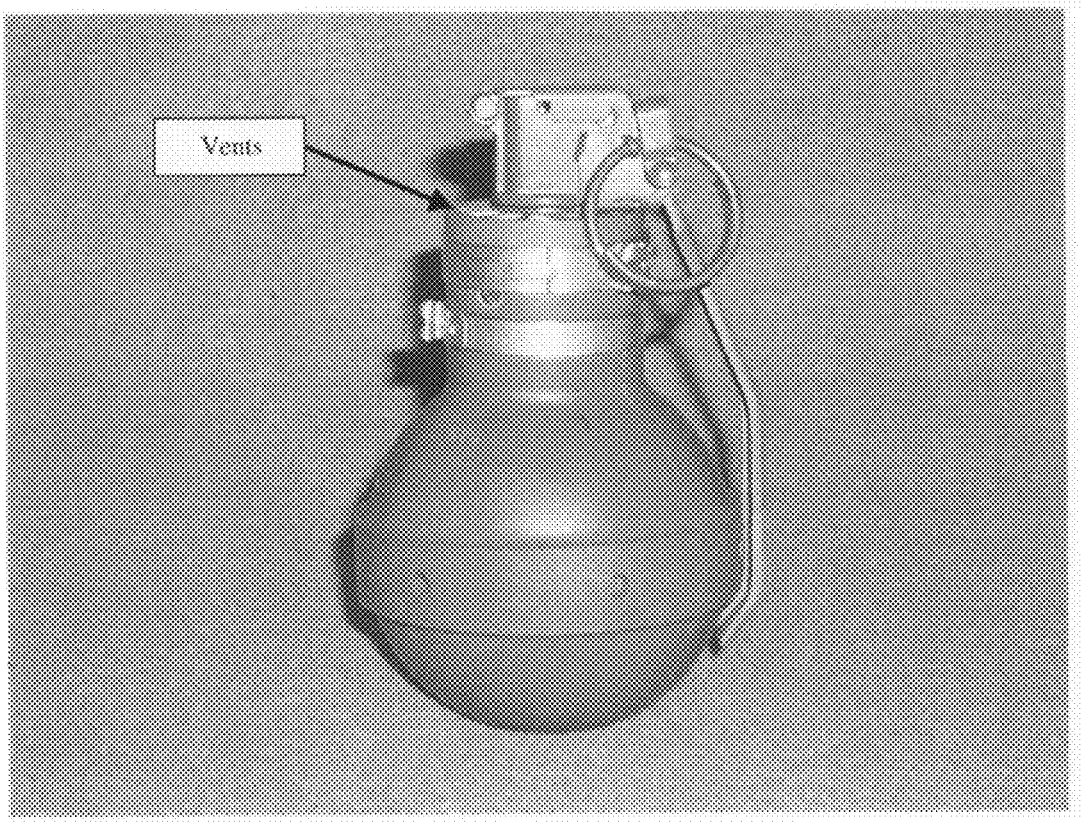
FIG. 5 shows the vents in the top portion of the housing of a trainer grenade according to a preferred embodiment of the present invention.

In addition, the body of a trainer grenade according to the preferred embodiment of the present invention has vents located in the circular top portion into which the fuze assembly is screwed. Thus, when the output charge detonates, the sound and explosive gasses will be discharged through the top, further simulating the live grenade. Moreover, the body of the trainer grenade can be used repeatedly. The vents are shown in FIG. 5, a photograph of a trainer grenade according to the presently preferred embodiment of the present invention.

In summary, some of the features of the preferred embodiment of the present invention include:

- Reusability of both the housing and fuze assembly because of the vents in the top portion of the housing;
- Reverse threading of the housing and fuze assembly, thereby preventing mix-ups with the components of a live grenade;
- A much larger fuze charge, thereby mimicking the explosion caused by a live grenade;
- A two part fuze charge, thereby simulating the delay before the explosion; and
- Optional color coding to provide additional distinguishing marks from a live grenade.

It should be noted that the presently preferred embodiment simulates the actions of a live grenade without requiring the electronic circuitry of the prior art, thereby providing a more robust trainer grenade.

While there have shown and described and pointed out fundamental novel features of the invention as applied to presently preferred embodiments thereof, it will be understood that various omissions and substitutions and changes in the form and details of the substances, constructions, and orientations illustrated and described, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A training device for simulating a grenade, comprising
a housing having substantially the same weight and dimensions as the housing of the grenade being simulated, said housing comprising:
a threaded opening in a top portion of said housing, wherein the threading of the threaded opening is the reverse of the threading of the threaded opening in the grenade being simulated; and
a plurality of vents surrounding a periphery of the threaded opening; and
a fuze assembly having substantially the same dimensions as the fuze assembly of the grenade being simulated, said fuze assembly comprising:
a threaded portion which screws into the threaded opening of the housing, wherein the threading of the threaded portion is the reverse of the threading of the threaded portion of the fuze assembly of the grenade being simulated; and
a tubular interior containing a two part fuze charge, said two part fuze charge comprising a delay charge, which is ignited by a striker and is located at an upper portion of said tubular interior, and an output charge, which is located in a lower portion of said tubular interior and is ignited by said delay charge;
wherein the two part fuze charge is a multiple in size of the fuze charge in the grenade being simulated; and
wherein, when the output charge detonates, the shock waves and explosive gasses resulting therefrom discharges out through the plural vents of the housing.

2. The training device of claim 1, wherein the grenade being simulated is a less-lethal grenade.

3. The training device of claim 1, wherein the housing is colored differently than the housing of the grenade being simulated.

4. The training device of claim 1, wherein the fuze assembly and housing remain substantially intact after detonation of the output charge, and can thereby be reused.

5. The training device of claim 1, wherein the two part fuze charge is about two to about eight times the size of the fuze charge in the grenade being simulated.

6. The training device of claim 1, wherein the two part fuze charge is about five times the size of the fuze charge in the grenade being simulated.

7. The training device of claim 1, wherein the housing is comprised of rubber.

8. A training device for simulating a grenade, comprising:
a housing having substantially the same weight and dimensions as the housing of the grenade being simulated, said housing comprising:
a threaded opening in a top portion of said housing, wherein the threading of the threaded opening is the reverse of the threading of the threaded opening in the grenade being simulated; and
a fuze assembly having substantially the same dimensions as the fuze assembly of the grenade being simulated, said fuze assembly comprising:
a threaded portion which screws into the threaded opening of the housing, wherein the threading of the threaded portion is the reverse of the threading of the threaded portion of the fuze assembly of the grenade being simulated.

9. The training device of claim 8, wherein the grenade being simulated is a less-lethal grenade.

10. The training device of claim 8, wherein the housing further comprises:
a plurality of vents surrounding a periphery of the threaded opening of the housing, wherein, when a charge inside the housing detonates, the shock waves and explosive gasses resulting therefrom discharges through said plural vents.

11. The training device of claim 10, wherein the fuze assembly and housing remain substantially intact after detonation of the output charge, and can thereby be reused.

12. The training device of claim 8, wherein the fuze assembly further comprises:
a tubular interior containing a two part fuze charge, said two part fuze charge comprising a delay charge, which is ignited by a striker and is located at an upper portion of said tubular interior, and an output charge, which is located in a lower portion of said tubular interior and is ignited by said delay charge.

13. The training device of claim 12, wherein the two part fuze charge is a multiple in size of the fuze charge in the grenade being simulated.

14. The training device of claim 12, wherein the two part fuze charge is about two to about eight times the size of the fuze charge in the grenade being simulated.

15. The training device of claim 12, wherein the two part fuze charge is about five times the size of the fuze charge in the grenade being simulated.

16. A training device for simulating a grenade, comprising:
a housing having substantially the same weight and dimensions as the housing of the grenade being simulated, said housing comprising:
a threaded opening in a top portion of said housing, wherein the threading of the threaded opening is the reverse of the threading of the threaded opening in the grenade being simulated; and
a fuze assembly having substantially the same dimensions as the fuze assembly of the grenade being simulated, said fuze assembly comprising:
a tubular interior containing a two part fuze charge, said two part fuze charge comprising a delay charge, which is ignited by a striker and is located at an upper portion of said tubular interior, and an output charge, which is located in a lower portion of said tubular interior and is ignited by said delay charge; and
a threaded portion which screws into the threaded opening of the housing, wherein the threading of the threaded portion is the reverse of the threading of the threaded portion of the fuze assembly of the grenade being simulated;
wherein the two part fuze charge is a multiple in size of the fuze charge in the grenade being simulated.

17. The training device of claim 16, wherein the grenade being simulated is a less-lethal grenade.

18. The training device of claim 16, wherein the two part fuze charge is about two to about eight times the size of the fuze charge in the grenade being simulated.

19. The training device of claim 16, wherein the two part fuze charge is about five times the size of the fuze charge in the grenade being simulated.

20. The training device of claim 16, wherein the housing further comprises:
a plurality of vents surrounding a periphery of the threaded opening of the housing, wherein, when a charge inside the housing detonates, the shock waves and explosive gasses resulting therefrom discharges through said plural vents.

21. The training device of claim 20, wherein the fuze assembly and housing remain substantially intact after detonation of the output charge, and can thereby be reused.

* * * * *